US007781656B2

(12) United States Patent
Furuta

(10) Patent No.: US 7,781,656 B2
(45) Date of Patent: Aug. 24, 2010

(54) STRAP CONNECTOR AND STRAP FOR MUSICAL INSTRUMENT HAVING STRAP CONNECTOR

(75) Inventor: Hajime Furuta, Nagoya (JP)

(73) Assignee: Hosino Gakki Co., Ltd. (JP)

( * ) Notice: Subject to any disclaimer, the term of this patent is extended or adjusted under 35 U.S.C. 154(b) by 0 days.

(21) Appl. No.: 12/360,295

(22) Filed: Jan. 27, 2009

(65) Prior Publication Data

US 2010/0107850 A1 May 6, 2010

(30) Foreign Application Priority Data

Oct. 30, 2008 (JP) ..... 2008-280006

(51) Int. Cl.
*G10D 3/00* (2006.01)

(52) U.S. Cl. ..... 84/327; 224/257

(58) Field of Classification Search ..... 84/327, 84/329; 224/257

See application file for complete search history.

(56) References Cited

U.S. PATENT DOCUMENTS 4,271,999 A * 6/1981 Stravitz ..... 224/257
6,590,145 B2 * 7/2003 Doiron ..... 84/327

FOREIGN PATENT DOCUMENTS

JP 2001-083962 3/2001

* cited by examiner

*Primary Examiner*—Jianchun Qin
(74) *Attorney, Agent, or Firm*—Ostrolenk Faber LLP

(57) ABSTRACT

A strap for a guitar has a strap belt and two strap connectors each of which is provided at each end of the strap belt. Each strap connector includes a base plate having a first opening, a second opening, and a slit. The first opening has a diameter greater than a head portion of a connector pin. The second opening has a diameter smaller than a neck portion of the connector pin. The slit connects the first and second openings and has a width smaller than the diameter of a neck portion of the connector pin. In the strap connector, a portion of the base plate adjacent to the slit is bendable.

11 Claims, 8 Drawing Sheets

STRAP CONNECTOR AND STRAP FOR MUSICAL INSTRUMENT HAVING STRAP CONNECTOR

BACKGROUND OF THE INVENTION

The present invention relates to a strap connector used for a strap for a musical instrument and a strap for a musical instrument having a strap connector.

This kind of strap for a musical instrument is disclosed in, for example, Japanese Laid-Open Patent Publication No. 2001-83962. As shown in FIGS. 11A and 11B, a strap for a musical instrument (hereinafter, referred to as a "strap") 100 has a strap belt 101, an adjuster 102 for adjusting the length of the strap belt 101 and a strap connector 103 that is provided at an end portion of the strap belt 101. A connector pin 203 is attached to a body 201 of an instrument 200 such that the strap connector 103 is attached to and detached from the connector pin 203. The strap connector 103 has a holding opening 104 where the connector pin 203 is inserted through and held and a slit 105 extending from the holding opening 104 to the strap belt 101. Before hanging the instrument 200 down from the shoulders or the neck, the player inserts the connector pin 203 to the slit 105 formed on the strap connector 103 to attach the strap 100 to the body 201 of the instrument 200.

However, in the conventional strap connector 103, it is difficult to insert the connector pin 203 to the slit 105 and the attachment to and detachment from the connector pin 203 is not easy. Therefore, for example, at a concert or a live performance, when the player prepares a plurality of guitars on the stage and changes the guitar for each tune, it is troublesome for the player to attach the strap to the guitar and detach the strap from the guitar. If the strap connector made of nylon or leather is used for a long time and the strap connector is repeatedly attached to and detached from the connector pin, the strap connector may be worn out and deformed or the strap connector may be hardened due to the deterioration with age of its material. Particularly, in this case, the attachment and detachment of the strap connector with respect to the connector pin become difficult and it takes time for the attachment and detachment of the strap.

BRIEF SUMMARY OF THE INVENTION

Accordingly, it is an objective of the present invention to provide a strap connector that allows easy attachment to and detachment from the connector pin and a strap for an instrument having the strap connector.

To achieve the foregoing objective and in accordance with a first aspect of the present invention, a strap connector used for a strap for a musical instrument is provided. The strap connector is attached to and detached from a connector pin attached to the musical instrument. The strap connector includes a base plate that includes a first opening having a diameter greater than a head portion of the connector pin, a second opening having a diameter smaller than the head portion of the connector pin, and a slit connecting the first opening and the second opening and having a width smaller than the diameter of a neck portion of the connector pin. A portion of the base plate adjacent to the slit is bendable.

In accordance with a second aspect of the present invention, a strap for a musical instrument having a strap belt and a strap connector is provided. The strap connector is provided at an end of the strap belt and attached to and detached from a connector pin that is attached to the musical instrument. The strap connector is formed by a base plate having a first opening, a second opening, and a slit. The first opening has a diameter greater than a head portion of the connector pin. The second opening has a diameter smaller than the head of the connector pin. The slit connects the first opening and the second opening and having a width smaller than the diameter of a neck portion of the connector pin. A portion of the base plate adjacent to the slit is bendable.

Other aspects and advantages of the present invention will become apparent from the following description, taken in conjunction with the accompanying drawings, illustrating by way of example the principles of the invention.

BRIEF DESCRIPTION OF THE SEVERAL VIEWS OF THE DRAWINGS

The invention, together with objects and advantages thereof, may best be understood by reference to the following description of the presently preferred embodiments together with the accompanying drawings in which.

DETAILED DESCRIPTION OF THE INVENTION

One embodiment in which a strap connector according to the present invention is applied to a guitar strap will now be described with reference to FIGS. 1 to 7.

Figure 1:
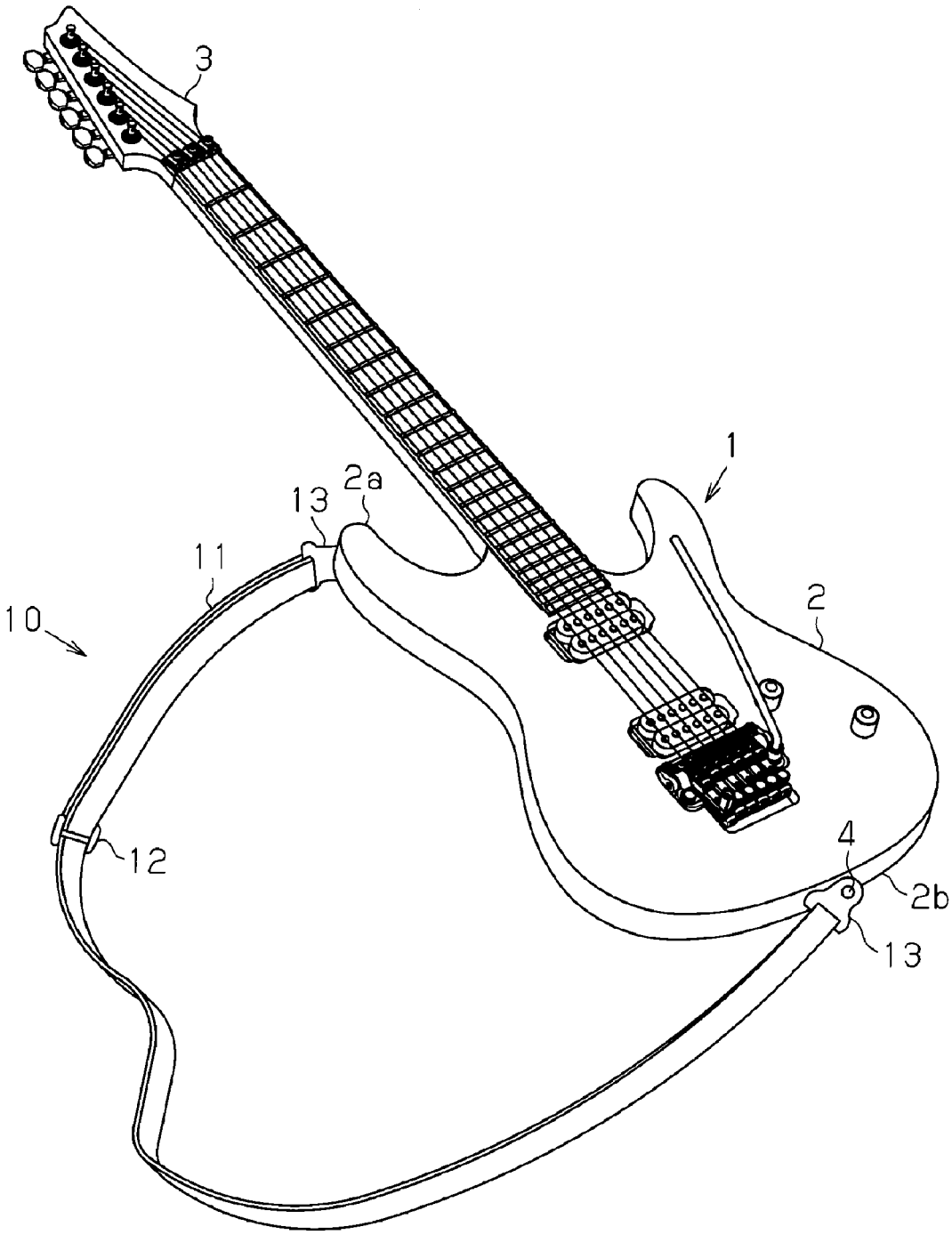
FIG. 1 is a perspective view showing a guitar strap having a strap connector according to one embodiment of the present invention attached to a guitar.

As shown in FIG. 1, a guitar strap (hereinafter, referred to as a "strap") 10 includes a strap belt 11 (hereinafter, referred to as a "belt"), an adjuster 12 which adjusts the length of the belt 11, and a pair of strap connectors 13, which are arranged at both ends of the belt 11. A body 2 of a guitar 1 has a connector pin 4 located at a first end 2*a* closer to a head 3 and a connector pin 4 arranged at a second end 2*b* opposite to the first end 2*a*. Before hanging the guitar 1 down from the shoulders, the player attaches the connector pins 4 to the strap connectors 13 to attach the strap 10 to the body 2 of the guitar 1.

Figure 2:
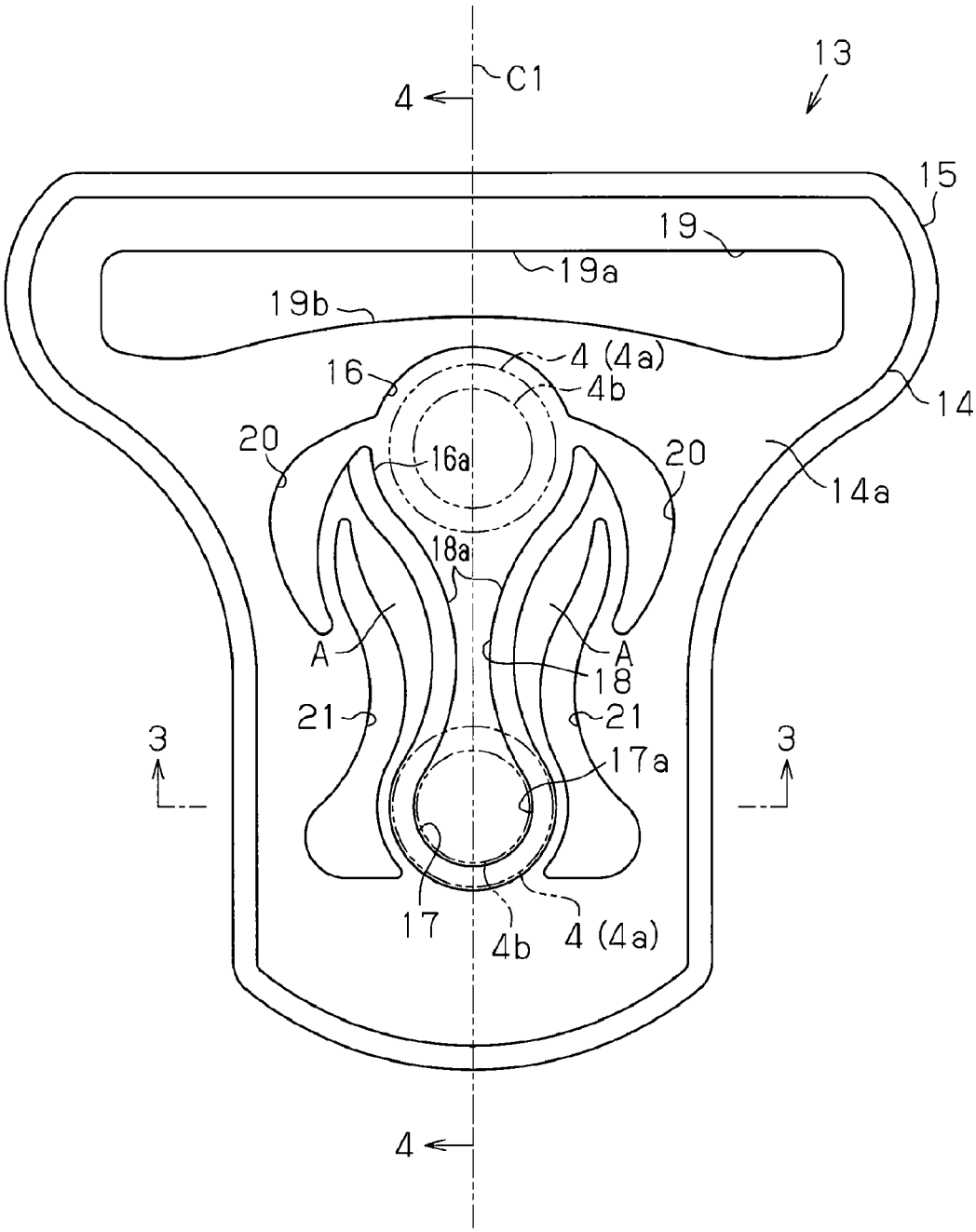
FIG. 2 is a plan view showing the strap connector.
Figure 3:
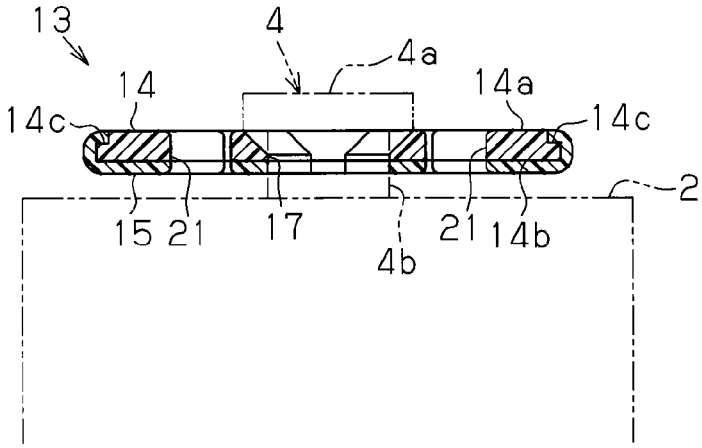
FIG. 3 is a cross-sectional view taken along line 3-3 of FIG. 2.
Figure 4:
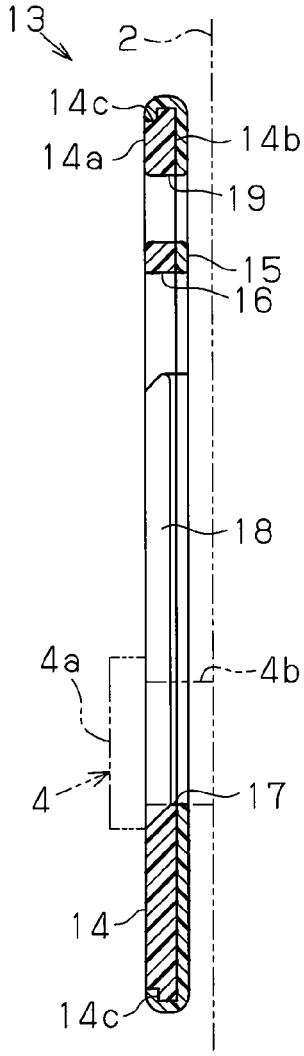
FIG. 4 is a cross-sectional view taken along line 4-4 of FIG. 2.

As shown in FIGS. 2 to 4, the strap connector 13 has a base plate 14 having a predetermined thickness and is substantially formed in a triangular and planar shape. The base plate 14 has a first surface 14*a* and a second surface 14*b* that is a back side of the first surface 14*a*. The first surface 14*a* forms an ornamental surface of the strap connector 13. Surface treatment such as frosting or mirror finish is performed to the first surface 14*a* of the base plate 14 to improve the appearance. A logo mark or a pattern that represents a brand name is printed or marked on the first surface 14*a* of the base plate 14.

An elastic member 15 is provided on the second surface 14*b*. The elastic member 15 is an impact absorbing member that absorbs an impact caused by contact between the second surface 14*b* and the guitar 1. The elastic member 15 is a sheet of an elastic material such as rubber or elastomer. The elastic member 15 is formed in a predetermined shape according to the shape and the size of the base plate 14. The elastic member 15 is integrally formed with the base plate 14 so as to cover the entire area of the second surface 14*b* and the entire outer periphery of the base plate 14. A step portion 14*c* having a L-shaped cross section is formed at the outer periphery of the base plate 14. The outer periphery of the elastic member 15 is fitted to the step portion 14*c* of the base plate 14. The strap connector 13 has an outer periphery of a substantially circular cross section by covering the elastic member 15 over the outer periphery of the base plate 14.

The base plate 14 is formed of a resin material having rigidity and formed by injection molding. A resin material having good molding property and high mechanical strength is used as the resin material for forming the base plate 14. For example, the resin material includes polyethylene resin, polycarbonate resin, and polyacetal resin. Polyacetal resin is most preferable because of its high mechanical strength, good durability, and good adhesion property with the elastic member 15 such as rubber or elastomer.

As described above, the strap connector 13 is a structural body that is integrally formed by the base plate 14 and the elastic member 15. The structural body has a first opening 16, a second opening 17, a slit 18 and an insertion opening 19. A head portion 4*a* of the connector pin 4 is inserted to the first opening 16. The connector pin 4 is held in the second opening 17. The slit 18 connects the first opening 16 and the second opening 17. The belt 11 is inserted through the insertion opening 19. The structural body further has two first elongated openings 20 and two second elongated openings 21. The first elongated openings 20 form a flexible portion A between each of the first elongated openings 20 and the slit 18. The second elongated openings 21 help bending at the portion A. In the present embodiment, the first and second openings 16, 17, the first elongated openings 20 and the slit 18 are formed so as to be connected to each other and form one opening. The second elongated openings 21 are independently formed.

The insertion opening 19 is formed at the vicinity of an upper end of the base plate 14 that is formed in a substantially inverted triangle. The insertion opening 19 is formed in an elongated opening extending along a lateral direction and formed to be longer than the width of the belt 11. The belt 11 is inserted through the insertion opening 19 of the base plate 14 and sewn on the belt 11 so as to be fixed to the upper end of the strap connector 13. An upper face 19*a* of the insertion opening 19 is flat and a lower face 19*b* of the insertion opening 19 has a curved face extending along an arc.

The first opening 16 is provided at the vicinity of the insertion opening 19 at a substantially center of the base plate 14. The first opening 16 is substantially circular. The first opening 16 is formed so as to receive the head portion 4*a* of the connector pin 4. Therefore, the diameter of the first opening 16 is greater than the diameter of the head portion 4*a* of the connector pin 4. Specifically, the diameter of the first opening 16 is set to be in a range of 11/10 to 3/2 of the diameter of the head portion 4*a* of the connector pin 4.

The second opening 17 is provided at a lower portion of the first opening 16 at the substantially center of the base plate 14. The second opening 17 is also formed in a substantially circle like the first opening 16. The second opening 17 holds the head portion 4*a* of the connector pin 4 so as to be prevented from dropping off. Therefore, the diameter of the second opening 17 is smaller than the diameter of the head portion 4*a* of the connector pin 4. The diameter of the second opening 17 is set to be equal to or greater than the diameter of a neck portion 4*b* of the connector pin 4. The first and second openings 16, 17 are arranged such that a center line of the openings 16, 17 coincide with an axial line C1 of the strap connector 13.

The slit 18 is formed to be curved. The slit 18 is arranged such that the axial line of the slit 18 coincides with the center line of the first and second openings 16, 17. The slit 18 has two facing inner surfaces 18*a*. The inner surfaces 18*a* of the slit 18 is curved surfaces extending along an arc. The width of the slit 18 is smallest at a center of the slit 18 and increases toward the first and second openings 16, 17. Specifically, the width of the slit 18 is set to be in a range of 2/3 to 1/4 of the diameter of the neck portion 4*b* of the connector pin 4 at the center of the slit 18.

At the upper end of the slit 18, the inner surface 18*a* of the slit 18 is connected to an inner peripheral surface 16*a* of the first opening 16 along a smooth curved line. Similarly, at the lower end of the slit 18, an inner peripheral surface 17*a* of the second opening 17 is connected to the inner surface 18*a* of the slit 18 along a smooth curved line. A portion of the inner peripheral surface 16*a* of the first opening 16 that is closer to the slit 18, the inner surfaces 18*a* of the slit 18 and the inner peripheral surface 17*a* of the second opening 17 are chamfered.

A pair of the first elongated openings 20 extend from the first opening 16 to the second opening 17. Each of the first elongated openings 20 is formed in a substantially crescent shape having the same size. The first elongated openings 20 are arranged to be symmetric with respect to the axial line C1 of the strap connector 13. A pair of the second elongated openings 21 extend from a position closer to the second opening 17 on the base plate 14 toward the first opening 16. Each of the second elongated openings 21 is formed in a substantially S-shape having the same size. The width of the second elongated opening 21 reduces from the lower end to the distal end of the second elongated opening 21. The second elongated openings 21 are arranged to be symmetric with respect to the axial line C1 of the strap connector 13 like the first elongated openings 20.

In the present embodiment, the two portions A each of which is surrounded by the slit 18 and each elongated opening 20, that is, the portions A of the base plate 14 that is adjacent to the slit 18 are formed to be bent. A pair of the second openings 17 are formed to help the bending of the portions A of the base plate 14 that are adjacent to the slit 18. Therefore, the slit 18 is capable of being deformed to be in a first shape (see FIG. 7A) and a second shape (see FIG. 7B) due to the bending of the portions A of the base plate 14 that are adjacent to the slit 18. In the first shape, the movement of the connector pin 4 between the first opening 16 and the second opening 17 is restricted. In the second shape, the movement of the connector pin 4 between the first opening 16 and the second opening 17 is allowed.

Figure 5C:
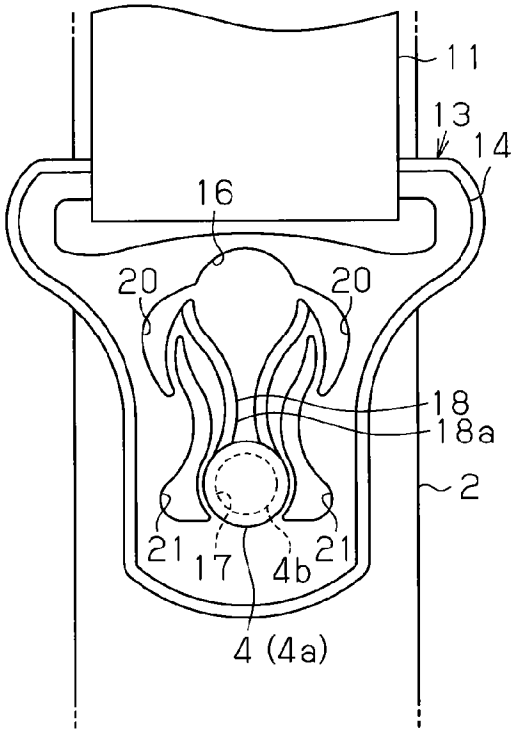
FIG. 5C is a partial plan view showing a state in which the connector pin is held in the second opening.
Figure 5B:
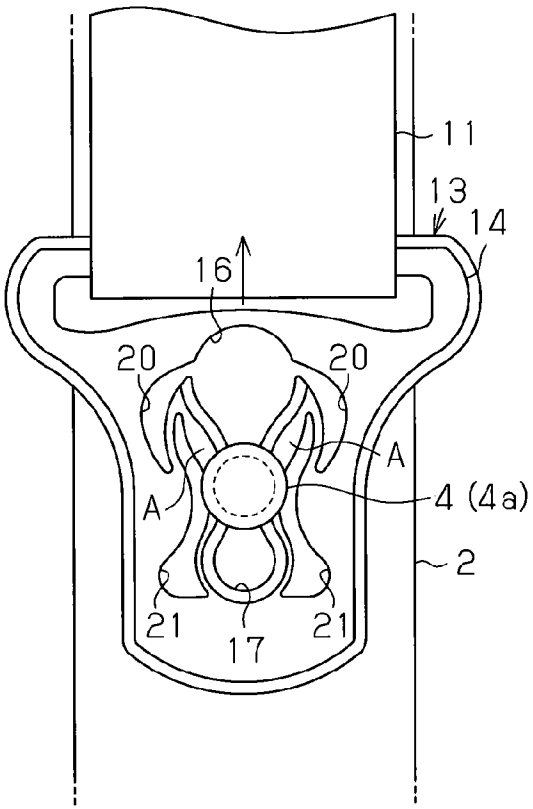
FIG. 5B is a partial plan view showing a state in which the connector pin passes through the slit.

Next, the attachment and detachment of the strap connector 13 with respect to the connector pin 4 will be explained with reference to FIGS. 5 to 7.

Figure 5A:
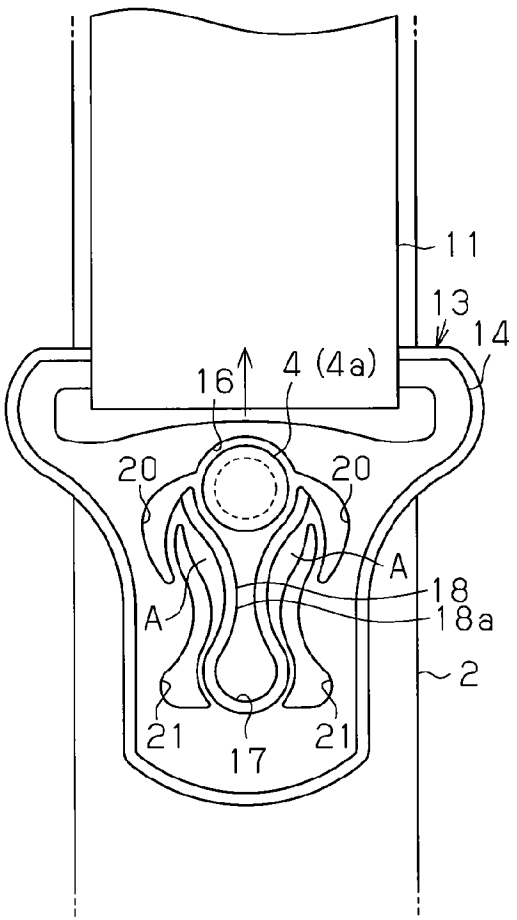
FIG. 5A is a partial plan view showing a state in which the connector pin is inserted to a first opening.
Figure 6:
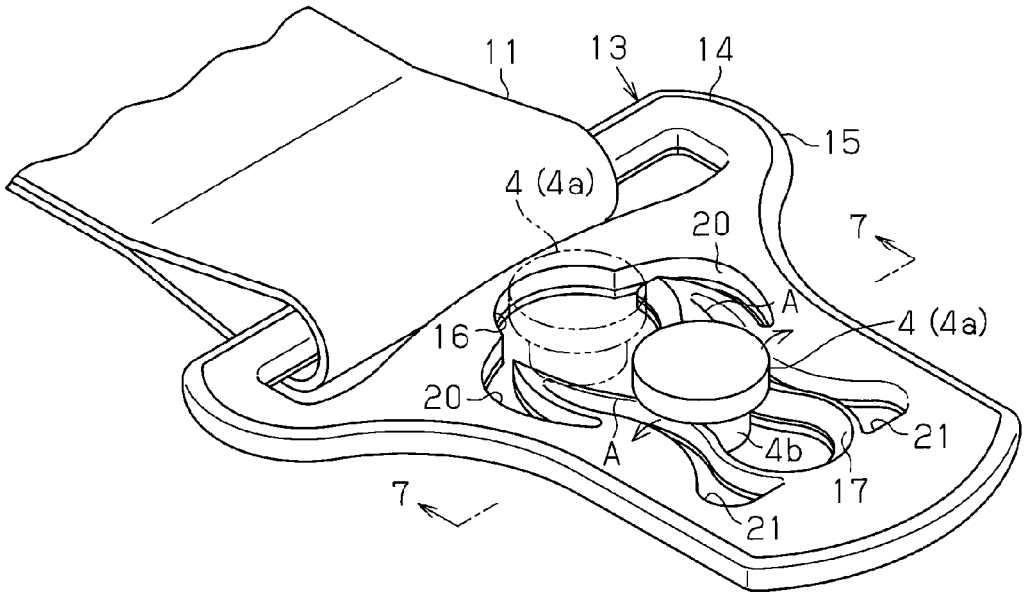
FIG. 6 is a partial perspective view showing a state in which the connector pin passes through the slit.
Figure 7A:
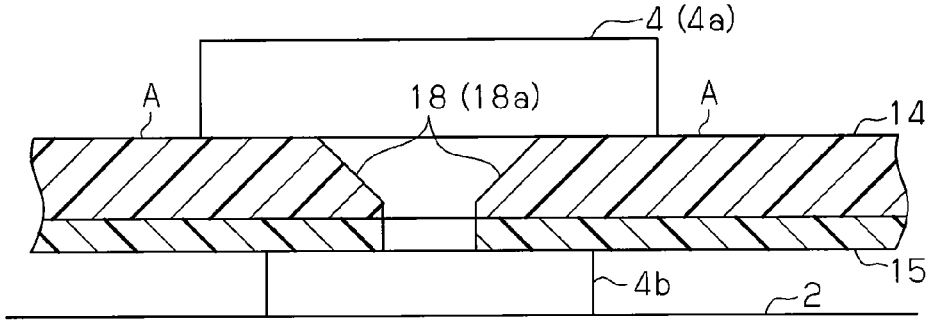
FIG. 7A is a partial cross-sectional view showing a state in which the connector pin is inserted to the first opening.

When the strap connector 13 is attached to the connector pin 4, the player inserts the head portion 4*a* of the connector pin 4 to the first opening 16 of the strap connector 13, as shown in FIG. 5A. At this time, since the diameter of the first opening 16 is greater than the head portion 4*a* of the connector pin 4, the head portion 4*a* of the connector pin 4 is easily inserted to the first opening 16. When the connector pin 4 is inserted to the first opening 16, the connector pin 4 does not contact the inner surface 18*a* of the slit 18 and does not press the inner surface 18*a* of the slit 18 even if the connector pin 4 contacts the inner surface 11*a* of the slit 18. Therefore, as shown in FIG. 7A, the portion A of the base plate 14 adjacent to the slit 18 is not bent. Therefore, the slit 18 is maintained to be in a first shape that restricts passing of the connector pin 4, and the center width of the slit 18 is smaller than the diameter of the neck portion 4*b* of the connector pin 4.

Figure 7B:
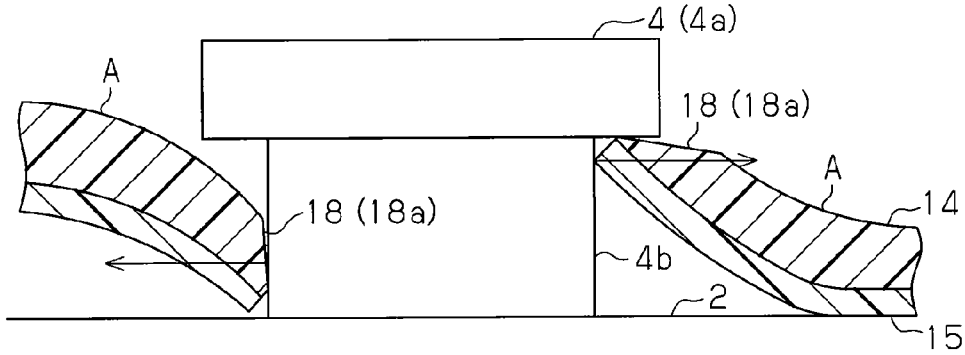
FIG. 7B is a partial cross-sectional view showing a state in which the connector pin passes through the slit.

Next, as shown in FIG. 5B, the player pulls up the strap connector 13 to pass the connector pin 4 through the slit 18 so that the connector pin 4 is fitted to the second opening 17. When the connector pin 4 passes through the slit 18, as shown in FIGS. 6 and 7B, the neck portion 4*b* of the connector pin 4 contacts the inner surface 18*a* of the slit 18 to press the two inner surfaces 18*a* laterally (in a direction of arrows shown in FIGS. 6 and 7B). As a result, the portion A of the base plate 14 adjacent to the slit 18 is bent and the slit 18 is pressed to be open from the first shape shown in FIG. 7A and to be deformed into the second shape (see FIG. 7B) that allows the connector pin 4 to pass through the slit 18. Accordingly, the connector pin 4 is allowed to pass through the slit 18 and the connector pin 4 is fitted to the second opening 17 as shown in FIG. 5C. The strap connector 13 is attached to the connector pin 4 and the strap 10 is attached to the body 2 of the guitar 1.

When the strap connector 13 is detached from the connector pin 4, the strap connector 13 is pressed up. Since the inner surface 18*a* of the slit 18 is pressed laterally (in a direction shown by arrows in FIGS. 6 and 7B) by the neck portion 4*b* of the connector pin 4, the portion A of the base plate 14 closer to the slit 18 is bent. Therefore, the slit 18 is pressed to be open from the first shape shown in FIG. 7A and deformed into the second shape shown in FIG. 7B. Accordingly, the connector pin 4 is allowed to pass through the slit 18 and the connector pin 4 is moved to the first opening 16 as shown in FIG. 5A. Accordingly, the strap connector 13 is detached from the connector pin 4 and the strap 10 is detached from the body 2 of the guitar 1.

According to the present embodiment, following advantages are obtained.

(1) Since the diameter of the first opening 16 is greater than the diameter of the head portion 4*a* of the connector pin 4 in the strap connector 13, the connector pin 4 is easily inserted to the first opening 16. Since the portion A of the base plate 14 adjacent to the slit 18 is bent, the connector pin 4 that is inserted to the first opening 16 passes through the slit 18 to be fitted to the second opening 17. Further, the connector pin 4 that is fitted to the second opening 17 passes through the slit 18 to be returned to the first opening 16 and detached from the strap connector 13. According to the series of operations, the strap connector 13 is easily attached to and detached from the connector pin 4.

(2) The base plate 14 is formed of a resin material having rigidity. According to this configuration, the base plate 14 forming the strap connector 13 has rigidity. Therefore, unlike the strap connector made of nylon or leather, the strap connector 13 is not worn out and deformed by repeating the attachment to and detachment from the connector pin 4, and the strap connector 13 is not hardened due to the deterioration with age of its material. This suppresses change in the size of the first opening 16, in which the connector pin 4 is inserted, and the slit 18, through which the connector pin 4 passes. Therefore, even if the attachment and detachment of the strap 10 is repeated, the strap connector 13 is smoothly attached to and detached from the connector pin 4.

(3) A pair of the first elongated openings 20 extend from the first opening 16 to the second opening 17. According to this configuration, since the two portions A that are surrounded by the slit 18 and a pair of the first elongated openings 20 are isolated from other portions, the portion A of the base plate 14 adjacent to the slit 18 can be bent. Accordingly, although the strap connector 13 has rigidity as a whole, a specific portion of the strap connector 13 has flexibility. Therefore, the strap connector 13 is easily attached to and detached from the connector pin 4 without deteriorating the function of the strap.

(4) A pair of the second elongated openings 21 extending from the vicinity of the second opening 17 to the first opening 16 are formed substantially at the center of the base plate 14. According to this configuration, the first and second elongated openings 20, 21 cooperate to help the bending of the portion A of the base plate 14 adjacent to the slit 18. This smoothly moves the connector pin 4 from the first opening 16 to the second opening 17 and moves the connector pin 4 from the second opening 17 to the first opening 16. Therefore, the strap connector 13 is further easily attached to the connector pin 4 and the strap connector 13 is further easily detached from the connector pin 4.

(5) At the upper end of the slit 18, the inner surface 18*a* of the slit 18 is connected to the inner peripheral surface 16*a* of the first opening 16 along a smooth curved line. According to this configuration, the connector pin 4 that is inserted to the first opening 16 passes through the slit 18 to be smoothly fitted to the second opening 17. Accordingly, the strap connector 13 is further easily attached to the connector pin 4.

(6) At the lower end of the slit 18, the inner peripheral surface 17*a* of the second opening 17 is connected to the inner surface 18*a* of the slit 18 along a smooth curved line. According to this configuration, the connector pin 4 that is fitted to the second opening 17 passes through the slit 18 to be smoothly returned to the first opening 16. Accordingly, the strap connector 13 is further easily detached from the connector pin 4.

(7) A pair of the inner surfaces 18*a* of the slit 18 are formed of curved surfaces extending along an arc. According to this configuration, the connector pin 4 is further smoothly moved from the first opening 16 to the second opening 17, and the connector pin 4 is further smoothly moved from the second opening 17 to the first opening 16. Accordingly, the strap connector 13 is further easily attached to the connector pin 4, and the strap connector 13 is further easily detached from the connector pin 4.

(8) At a concert or a live performance, when a player plays an instrument while moving, the strap connector 13 may contact the body 2 of the guitar 1 and damage the surface of the body 2. In the present embodiment, the elastic member 15 is provided on the second surface 14*b* of the base plate 14. The elastic member 15 functions as an impact absorbing member that absorbs an impact caused by the contact with the guitar 1. According to this configuration, even if the strap connector 13 contacts the body 2, the elastic member 15 absorbs the impact caused by the contact. This prevents the surface of the body 2 from being damaged.

(9) The resin material that forms the base plate 14 includes, for example, polyethylene resin, polycarbonate resin, and polyacetal resin. According to this configuration, since each of polyethylene resin, polycarbonate resin, and polyacetal resin has excellent mechanical strength and durability, the strap connector 13 having high strength and durability is provided.

The above embodiment may be modified as follows.

Figure 8:
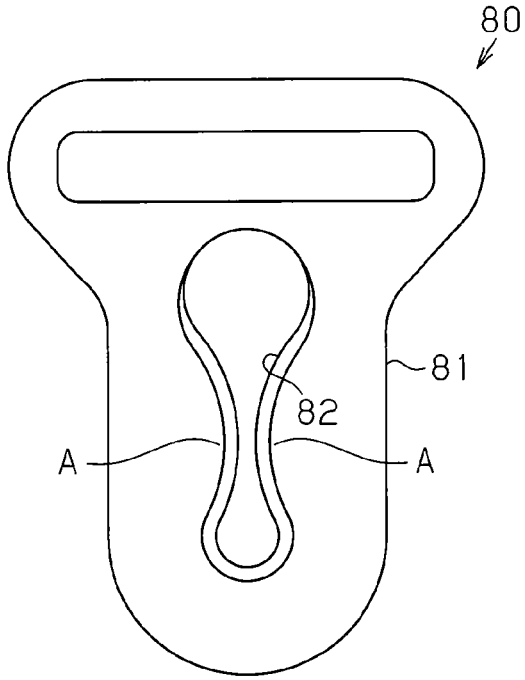
FIG. 8 is a plan view showing the strap connector according to a modification.

In the present embodiment, the first and second elongated openings 20, 21 may be omitted. For example, as shown in FIG. 8, a strap connector 80 without the first and second elongated openings 20, 21 may be used. In this case, for example, the portion A of the base plate 81 adjacent to the slit 82 may be formed to be thin to increase the flexibility. Only the portion A of the base plate 81 adjacent to the slit 82 may be formed of a flexible material and other portions may be formed of non-flexible material.

Figure 9:
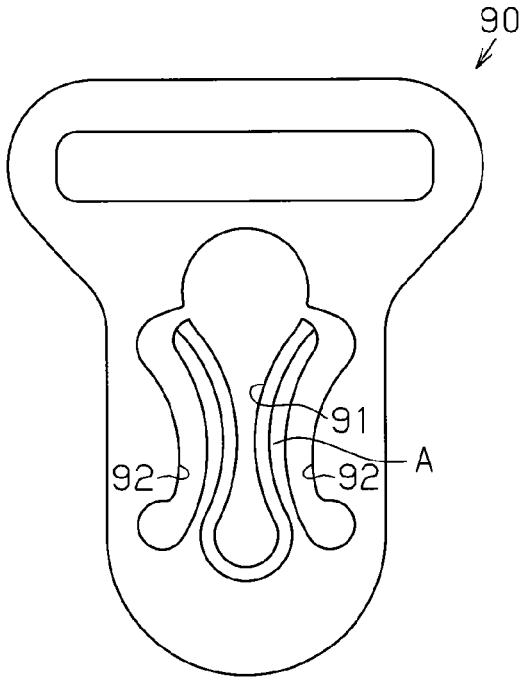
FIG. 9 is a plan view showing the strap connector according to a modification.

In the present embodiment, one of or both of the second elongated openings 21 may be omitted. For example, as shown in FIG. 9, a strap connector 90 without the second elongated openings 21 may be used. In this case, in the strap connector 90, the portion A formed in an approximately C shape that is surrounded by the slit 91 and each of the first elongated openings 92 is bent.

Figure 10A:
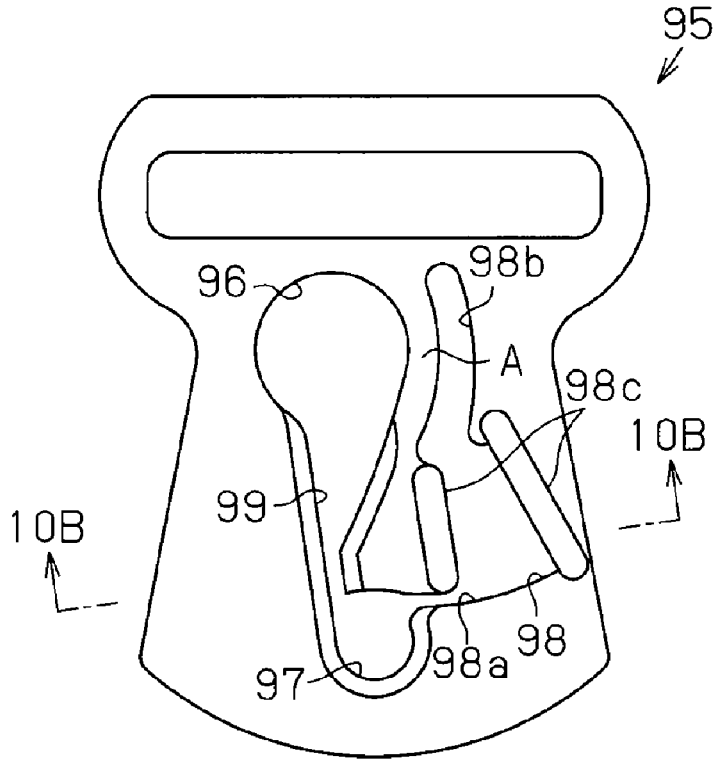
FIG. 10A is a plan view showing the strap connector according to a modification.
Figure 10B:
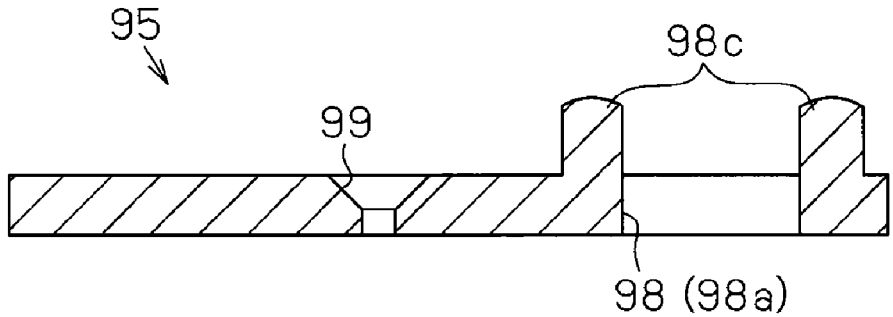
FIG. 10B is a cross-sectional view showing the strap connector according to a modification.
Figure 11A:
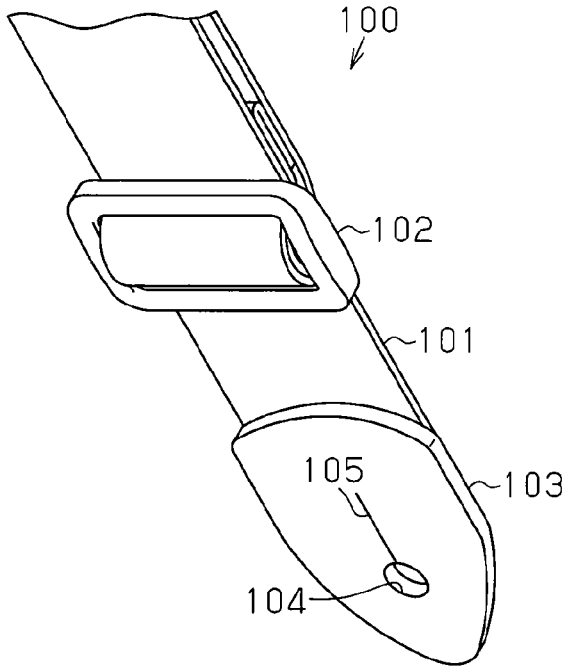
Fig.11A Prior Art
FIG. 11A is a partial perspective view showing a prior art strap connector.
Figure 11B:
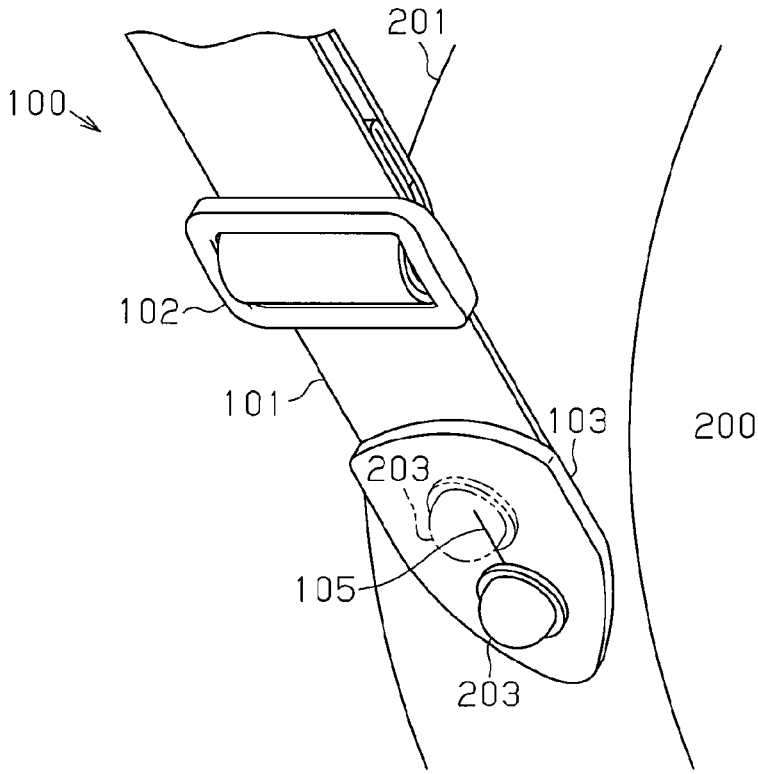
Fig.11B Prior Art
FIG. 11B is a partial perspective view showing a state in which the prior art strap connector is attached to the connector pin.

In the present embodiment, one or both of the first elongated openings 20 may be omitted. For example, as shown in FIGS. 10A and 10B, a strap connector 95 having a second elongated opening 98 extending from a second opening 97 to a first opening 96 may be used. The second elongated opening 98 has a rectangular opening 98*a* formed in an approximately trapezoid that is closer to the second opening 97 and a long opening 98*b* extending upwardly from the rectangular opening 98*a*. In this case, in the strap connector 95, the portion A formed in an approximately C shape that is surrounded by the slit 99 and the long opening 98*b* is bent. A pair of holding portions 98*c* are provided on the two sides of the rectangular opening 98*a*. The holding portions 98*c* are used to increase the width of the slit 99.

In the present embodiment, the first and second openings 16, 17 may be formed in, for example, an oval or a rhombus. The first and second elongated openings 20, 21 may be formed in any other shapes with taking the design of the strap connector 13 into consideration.

In the present embodiment, the base plate 14 may be formed of, for example, any materials having rigidity such as wood, metal and high-strength rubber.

In the present embodiment, the inner peripheral surface 16*a* of the first opening 16 does not need to be connected to the inner surface 18*a* of the slit 18 along the smooth curved line. The inner peripheral surface 16*a* of the first opening 16 and the inner surface 18*a* of the slit 18 may be crossed at an obtuse angle.

In the present embodiment, the slit 18 does not need to be curved. The facing two inner surfaces 18*a* of the slit 18 may be flat faces that are arranged parallel to each other.

In the present embodiment, the elastic member 15 may be omitted from the strap connector 13. The elastic member 15 does not need to be formed of the elastic material such as rubber or elastomer, but may be formed of a material having good cushioning such as sponge or felt.

The strap connector 13 of the present invention is applied to the strap 10 for a guitar, but may be applied to the strap for a keyboard or an electric base.

The strap 10 for a musical instrument of the present invention is used for a guitar, but may be used for a keyboard or an electric base.

Therefore, the present examples and embodiments are to be considered as illustrative and not restrictive and the invention is not to be limited to the details given herein, but may be modified within the scope and equivalence of the appended claims.

The invention claimed is:

1. A strap connector for a strap for a musical instrument, the strap connector being configured to be attached to and to be detached from a connector pin attached to the musical instrument, the strap connector comprising a base plate that includes:

a first opening having a diameter greater than a head portion of the connector pin;

a second opening having a diameter smaller than the head portion of the connector pin;

a slit connecting the first opening and the second opening and having a width smaller than the diameter of a neck portion of the connector pin, wherein a portion of the base plate adjacent to the slit is bendable;

the base plate further comprising:

a first elongated opening extending from the first opening in a direction of the second opening, a second elongated opening having a first end closer to the second opening than to the first opening and extending in a direction of the first opening, a third elongated opening symmetrical with respect to the slit to the first elongated opening, and a fourth elongated opening symmetrical with respect to the slit to the second elongated opening.

2. The strap connector according to claim 1, wherein the base plate is formed of a material having rigidity.

3. The strap connector according to claim 1, wherein an inner peripheral surface of the first opening is connected to an inner surface of the slit along a smooth curved line.

4. The strap connector according to claim 1, wherein an inner peripheral surface of the second opening is connected to an inner surface of the slit along a smooth curved line.

5. The strap connector according to claim 1, wherein an inner surface of the slit is a curved surface extending along an arc.

6. The strap connector according to claim 1, wherein the base plate has a first surface and a second surface, the first surface forming an ornamental surface, and the second surface is a back surface of the first surface, wherein an impact absorbing member is provided on the second surface so as to absorb an impact caused by contact with the musical instrument.

7. The strap connector according to claim 1, wherein the base plate is made of polyethylene resin, polycarbonate resin, or polyacetal resin.

8. A strap for a musical instrument having a strap belt and the strap connector of claim 1, wherein the strap connector is provided at an end of the strap belt and is configured to be attached to and to be detached from a connector pin that is attached to the musical instrument.

9. The strap connector of claim 1, wherein the first elongated opening has a first end in the first opening and a second end avoiding direct contact with the second opening.

10. The strap connector of claim 1, wherein the second elongated opening is free of direct contact with any other opening.

11. The strap connector of claim 1, wherein the second elongated opening has a second end at a position closer to the first opening than to the second opening.

* * * * *

UNITED STATES PATENT AND TRADEMARK OFFICE

CERTIFICATE OF CORRECTION

PATENT NO. : 7,781,656 B2
APPLICATION NO. : 12/360295
DATED : August 24, 2010
INVENTOR(S) : Hajime Furuta It is certified that error appears in the above-identified patent and that said Letters Patent is hereby corrected as shown below:

On the Title page

Item (73) Assignee should read:

Hoshino Gakki Co., Ltd.

Signed and Sealed this

Sixteenth Day of November, 2010

David J. Kappos

David J. Kappos
*Director of the United States Patent and Trademark Office*